US006662543B2

(12) United States Patent
Schuller et al.

(10) Patent No.: US 6,662,543 B2
(45) Date of Patent: Dec. 16, 2003

(54) PROCEDURE AND AN APPARATUS FOR THE REWORKING OF OPEN-END ROTOR SPINNING APPARATUSES

(75) Inventors: Edmund Schuller, Ingolstadt (DE); Manfred Knabel, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 91 days.

(21) Appl. No.: 09/934,804

(22) Filed: Aug. 22, 2001

(65) Prior Publication Data

US 2003/0136100 A1 Jul. 24, 2003

(30) Foreign Application Priority Data

Sep. 22, 2000 (DE) ..... 100 46 984

(51) Int. Cl.[7] ..... D01H 4/12
(52) U.S. Cl. ..... 57/406; 57/112; 57/404
(58) Field of Search ..... 57/112, 404, 406, 57/407; 384/100, 107, 109, 121, 420, 452, 453, 590, 592, 609, 610

(56) References Cited

U.S. PATENT DOCUMENTS 4,167,845 A 9/1979 Münnich et al.
5,098,205 A 3/1992 Zehndbauer et al.
5,634,326 A * 6/1997 Wanger ..... 57/406
5,855,110 A * 1/1999 Bock et al. ..... 57/406
6,032,452 A 3/2000 Zott
2002/0110294 A1 * 8/2002 Pohn et al. ..... 384/100

FOREIGN PATENT DOCUMENTS

DE 3811627 C2 12/1988
DE 4121387 A1 1/1993
DE 4325305 A1 * 2/1994 ..... D01H/4/12

OTHER PUBLICATIONS

German Search Report, Jan. 31, 2001.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

The present invention concerns a procedure for the reworking of a open-end spinning apparatus for a spin rotor, which is carried in the V-notch between support disks and is supported by a ball axial thrust bearing. Where the reworking is concerned, the bearing block of the open-end spinning apparatus is dismounted, the ball axial thrust bearing is removed from the bearing block and in accord with the invention, is replaced by an aerostatic bearing in the bearing block.

20 Claims, 3 Drawing Sheets

PROCEDURE AND AN APPARATUS FOR THE REWORKING OF OPEN-END ROTOR SPINNING APPARATUSES

BACKGROUND OF THE INVENTION

The present application concerns a procedure for the reworking of an open-end spinning apparatus as well as a bearing arrangement for a spin rotor of an open end spinning apparatus. Open-end rotor spinning apparatuses for open-end spinning machines, for example, such as are made by the firm W. Schlafhorst AG & Co. and Rieter Ingolstadt Spinning Machine Construction AG, are generally comprised of a multiplicity of spinning elements as well as a plurality of apparatuses for the winding of the spun yarn. Such a spinning unit possesses a spin rotor, which, by means of a drive motor, is set into rotational motion. Of considerable importance in this matter is the manner in which the spin rotor is carried on its bearings.

The bearing assembly for the rotor shaft divides itself into a radial and an axial bearing system. In the case of the radial bearing, the spin rotor is set into a V-shaped notch between two support disks. The axial bearing arrangement, and the reaction to the axial force caused by the spin rotor which this generates during operation, is contained on a thrust bearing. Until a few years previously, the axial thrust bearing in the case of machines of the above described manufacturers, and thereby a substantial part of this type of spinning machines, was equipped with a ball on which the rotor shaft rested while turning. The necessary lubrication of this ball was carried out with the aid of an appropriate lubricant.

These types of axial bearing arrangements, however, have the disadvantage that, in order to enable the important rotation of the ball, special demands were called for in regard to the lubrication. In the majority of cases, for this reason, these balls were placed above an oil bath or an oil-containing medium for lubrication. Besides the continuous rotation of the ball, and therewith the danger of considerable abrasive wear, this kind of axial rotor bearing arrangement had the additional disadvantage that lubricant, because of the vibration and high RPM of the rotor shaft, migrated out of the bearing box and contaminated the spinning machine, i.e., the spinning apparatus. Because of the oily surfaces in the bearing area, it happened that fine dusts and fibers of the spinning process could agglomerate on the machine and encrust themselves. This buildup could then lead to disadvantages in the formation of yarn. Such waste material patches that loosened themselves could enter into the to-be-spun fiber material and cause subsequent contamination and non-uniformities in the product.

Moreover, these contaminating deposits had the disadvantage that a large maintenance expense continually accrued. Thus, at regular periods, a cleaning of the spinning machine as well as a monitoring of the lubrication supply of the axial bearing had to be done. Under these circumstances, it was often necessary to refill the lubricant containers, which increased the maintenance time even more.

In order to set aside the disadvantages of spinning machines with open-end spin rotors supported by bearings of this kind, the state of the technology developed a different approach to axial bearing systems. The arrangement of the bearings for the spin rotors was done without the ball and further allowed the removal of the lubrication, which contaminated the fibers. This type of bearing support has been made known by EP 0 435 016 A2.

Following the introduction of this type of pneumatically driven axial thrust bearing system, which avoided the above described disadvantages, attempts were made to substitute these modem bearing arrangements with simplified ball axial thrust bearings, where the construction of the bearing assembly was simple to the extent that an exchange of these two bearing systems could be carried out. For this required construction, the improved version of the pneumatic axial thrust bearing arrangement was used, and the ball axial thrust bearing was simply installed in the receiving enclosure of this modem pneumatic bearing. By this means, a version (minimized in size) of the known oil lubricated, ball axial thrust bearing assembly was pushed into the receiving housing for the modem pneumatic axial bearing system. Through this kind of retrofit of the bearing assembly with conventional systems, the desired advantages of the modem axial bearing methods were circumvented in order to substitute for them apparatuses which were constructed according to the older types of bearings. This kind of bearing design still, as demanded by its components, called for an oil-based lubrication. Instead of refitting the obsolete bearing system with modem pneumatic bearings, the state of the technology, contrary to this, surprisingly simply retrofitted the modem and improved bearing system with the old.

OBJECTS AND SUMMARY OF THE INVENTION

Thus, it is a principal object of the invention to allow many thousands of spinning apparatuses now in operation with an oil-media lubrication system of the rotor to be reworked without great cost by an appropriate procedure and an apparatus to execute the procedure. The reworking would permit the spinning apparatuses to meet the demands, which have been placed on spinning machines without the necessity of replacing the complete spinning apparatus or machine. The investment amounts for the modernization are held to a minimum and remain restricted to the necessary components. Additional objects and advantages of the invention will be set forth in part in the following description, or may be obvious from the description, or may be learned through practice of the invention.

The present purpose of the invention is solved by dismounting the bearing block from the open-end spinning apparatus, separating the axial bearing from the bearing block, and replacing it with an axial bearing carrier for an aerostatic axial bearing equipped with a matching surface on the bearing block. The reworking allows, in this operation, only a small expenditure of time and money in comparison to the substitution of new spinning machines or a new, modernized open-end spinning machine for machines containing the axial ball bearings.

Reworked open-end rotor spinning machines retain essentially the same advantages in regard to the character of the bearing assemblies as do newly purchased open-end rotor spinning machines already equipped with the recently installed pneumatic axial bearing system for the spin rotor. For the rework, essentially only the bearing block of the open-end rotor apparatus to be reworked needs to be dismantled, following which, in a simple manner, the axial bearing assembly found on the block can be separated, and, in accord with the invention, replaced with an axial pneumatic bearing carrying block.

The reworking can even be accelerated by, for example, doing the reworking section by section. The corresponding parts of the rotor bearing assembly on the open-end spinning machine can be removed and reworked in one section, while the other sections of the spinning machine remain in operation. In another advantageous method, already reworked bearing assemblies can be held on the ready, so that, upon the next removal of the original bearing, the new component can serve as an immediate replacement. Thus, only a very short break in production would occur. The now removed original bearing assemblies, can be reworked at an optional time and place, so that, subsequently, these reworked assemblies can be exchanged piece for piece for existing original bearing assemblies.

In an advantageous development of the invented procedure, the removal of the ball axial bearing assembly can be effected by machine cutting, for instance, by sawing or milling, or even by non-machine cutting such as by laser or by electron beam. In this way, a plane of separation, i.e., a separating surface, is generated quickly and advantageously, which can be immediately turned to rework operations. Preferably, this follows as an additional step in the procedure. Also, the plane surface is generated with a minimum of roughness depth, which advantageously serves as a matching surface for another complementary surface. Such a plane surface improves the fitting of the axial bearing block surface to the existing bearing block.

The separation of the ball axial bearing is carried out favorably in such a manner that the plane in which the separation occurred lies parallel to the plane in which the support disks lie, that is, that plane which is formed by the support disk pair proximal to the rotor, or the support disk pair proximal to the shaft end. Advantageously, the separation can be made between the two planes of the two above mentioned pairs of support disks. An advantageous separation line can be achieved by having the line in its course suddenly bend, and run perpendicular to the above described planes of the support disks.

The axial bearing carrier is advantageously designed with a corresponding matching surface, so that the separating surface is appropriate for the fitting of the axial bearing carrier onto the existing bearing block. This match is especially true, when the bearing block has been correspondingly machined. In a further advantageous development of the procedure, the separating surfaces are provided with fastening means for their union. In this way, the advantage is gained that the fastening of the axial bearing carrier is simple and quick, as well as being exact in surface match. In a particularly favorable option, the fastening means includes a boring, which preferably possesses an inner threading. Thereby, the fixing of the axial bearing carrier onto the existing bearing block is very simple, i.e., with threaded bolts.

By means of the invented bearing arrangement, an economical bearing has been constructed, the bearing block of which retains the advantages of the original bearing system of the spin rotor by means of support disks and at the same time inherently possesses the advantages of a pneumatic axial bearing of the spin rotor. For this purpose, the axial bearing carrier is equipped with a receptor for a bearing surface of a pneumatic axial bearing. By means of the construction of a matching surface, no further measures are required for the installation of the bearing surface of the axial bearing to the spin rotor, at least that call for a change of the angularity of the bearing surface in relation to the axis of the rotor shaft.

In a particularly advantageous development of the bearings, the separating and the matching surfaces are simultaneously shaped, so that they, in connection with the axial bearing carrier, assure that no adjustments are necessary which alter the placement of the bearing surface in the axial direction of the spin rotor. This is particularly favorable, since no time for such adjustment can be lost and, moreover, no special knowledge is required of the maintenance personnel. The separation surface is machined for this reason in accord with the invention. The separation surface forms a centering and positioning surface of the bearing plate of the axial bearing for the rotor shaft, which will be rotationally carried thereon.

In a particularly advantageous improvement of the invention, the separation surface is provided with fastening means with the help of which the fastening of the bearing carrier is simple and advantageous. In a particularly advantageous development of the invention, this fastening means is a boring provided with a thread. In a further advantageous improvement of the invention, the separation surface possesses a centering means for the centering, or alignment, of the bearing carrier onto the existing bearing block. For example, these centering means might be centering pins, or complementary borings for the same. By these alignment means, a rapid and sure centering of the bearing carrier on the existing bearing block can be carried out during the installation. These alignment means simplify the mounting and accelerate the installation of the bearing components and thereupon the rework of the open-end rotor spin apparatus.

BRIEF DESCRIPTION OF THE DRAWINGS

In the following, the invention will be described with the aid of the drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
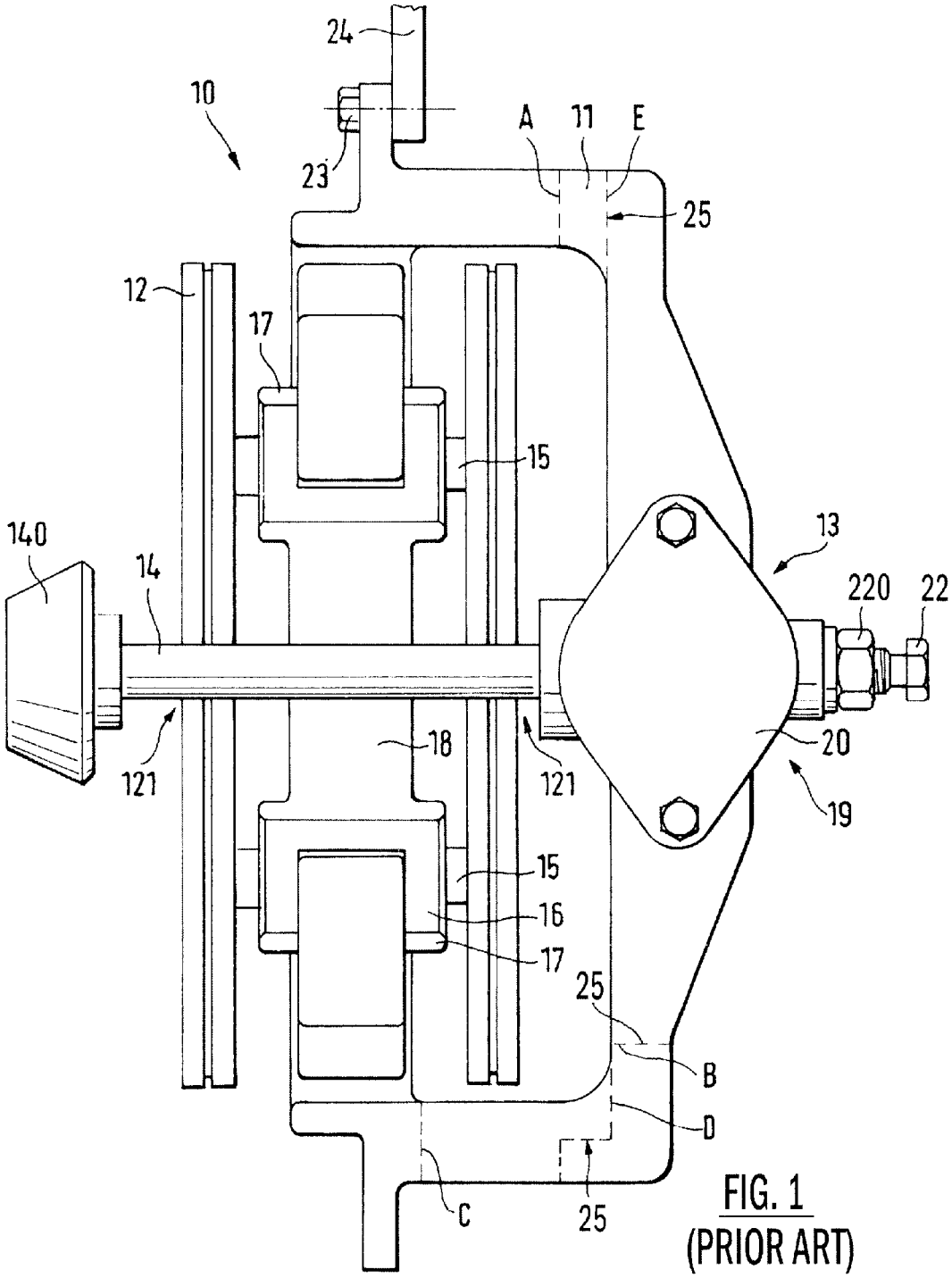
FIG. 1 (PRIOR ART)
FIG. 1 shows a bearing assembly of an open-end rotor spinning apparatus before the reworking.
Figure 2:
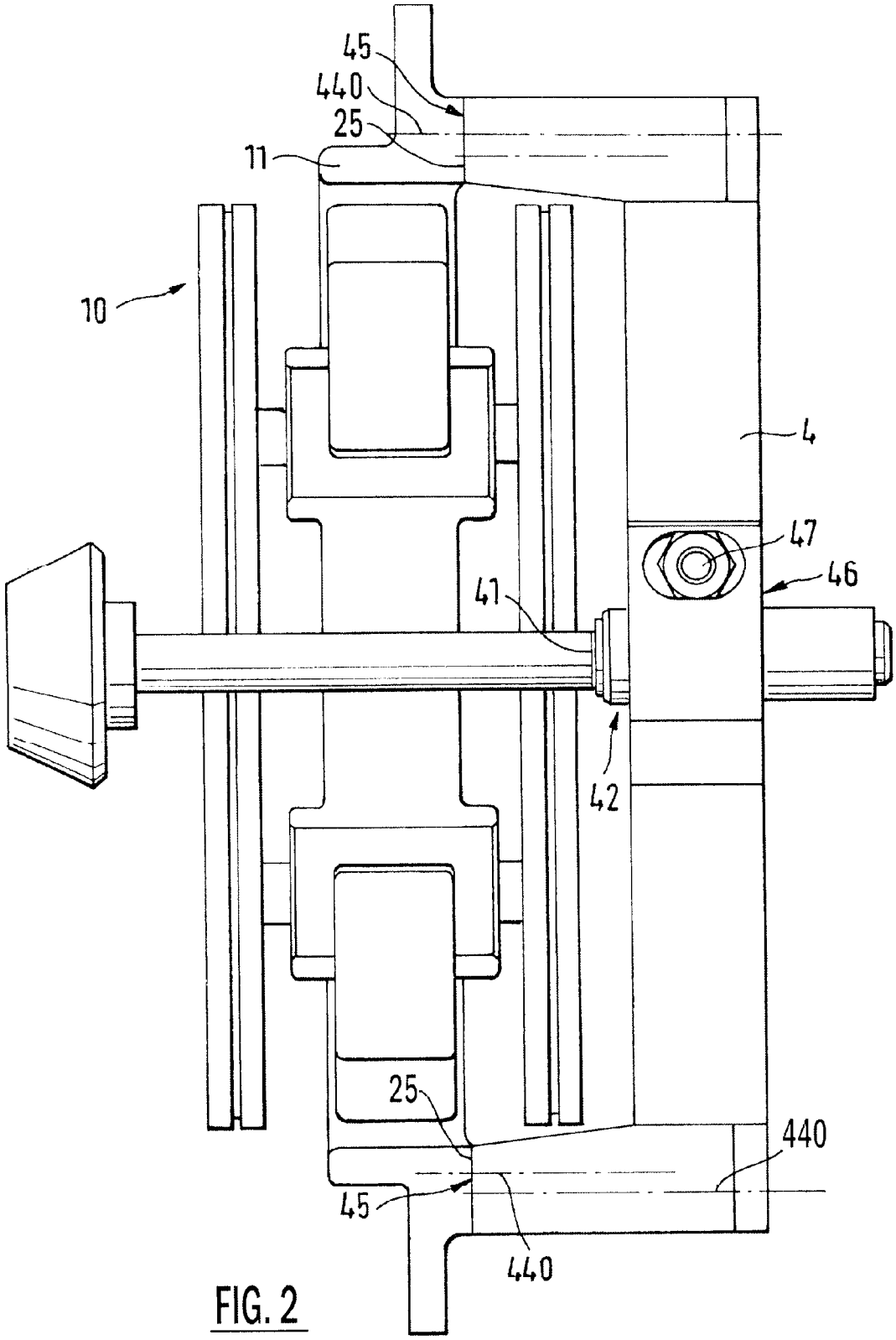
FIG. 2 shows the reworked view of the assembly of FIG. 1, following the installation of the axial bearing carrier of an aerostatic axial bearing.
Figure 3:
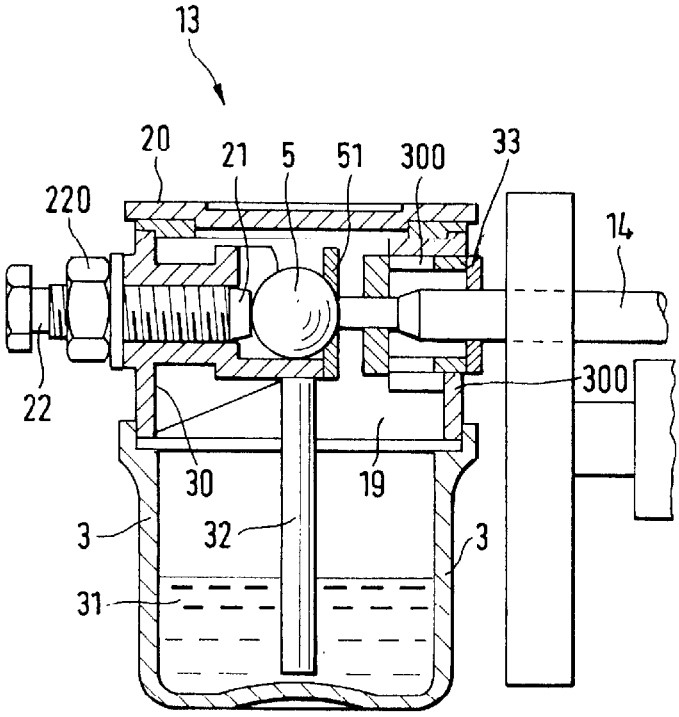
FIG. 3 (PRIOR ART)
FIG. 3 shows the ball axial thrust bearing of FIG. 1 in a cross-sectional view.

FIG. 1, in combination with FIG. 3, shows the bearing arrangement of an open-end spinning apparatus, in accord with the state of the technology, with a ball axial bearing 13 prior to the rework operation. The bearing arrangement 10 comprises one bearing block 11 on which the support disks 12 as well as the ball axial bearing 13 are placed. Such a bearing arrangement, for instance, is made known by DE 41 21 387 A1, (see FIG. 2 of that patent). In the bearing system of FIG. 1, the support disks 12 are arranged pairwise, so that they present two V-notches 121 in which the rotor shaft is carried. At the end remote from the ball axial bearing 13, the rotor shaft 14 carries the open-end spin rotor 140. Due to a (not shown) driving element, which, in the state of the technology is largely based on tangential belts, the spin rotor 140 is driven by the rotor shaft 14 and set into rotation. Respectively, two support disks 12 bound to one another are driven by an axle 15 and carried on support disk bearing 16.

The support disk bearings 16 are received in a semicircular recess 17. By means of clamp 18, the support disk bearings 16 are pressed into the recess 17 of the bearing block 11 and there retained. The clamp 18, at the same time, is affixed to the bearing block 11. The axles 15 of the support disks 12 are slightly skewed in relation to one another to the effect that the V-notch 121 between the support disks 12 generates an axial thrust against the rotor shaft 14, which rests on the V-notch of the disks, in the direction of the ball axial bearing of the bearing assembly 10.

The ball axial bearing 13 possesses a container 19 which is closed by a cover 20. Within the container 19, a ball 5 is found at the elevation of and abutting the rotor shaft 14. The ball supports itself on the side remote from the rotor shaft 14 on a recessed detent 21, which accepts the ball in a cuplike receiver. The recessed detent 21 can be adjusted with an adjustment screw 22, which is locked by means of the nut 220.

For the necessary lubrication of the ball 5, the ball axial bearing 13 possesses a container 3, which is remote from the cover. The container 3 holds the lubricant 31 which lubricates the ball during its rotation. The lubricant 31 is brought to the point of lubrication of the ball 5 by means of a wick 32.

The bearing block 11 is fastened to the spinning machine framing 24 by means of the fastening screws 23, which is shown only schematically. For the proposed rework of the open-end spinning apparatus, the bearing block 11 must first be removed from the spinning machine, and thus demounted from the spinning apparatus by the loosening of the fastening screws 23. For this purpose, it is advantageous to stop the rotor driving means (not shown), so that the bearing block with the support disks 12 and the ball axial bearing 13 can be taken out of the spinning machine. Prior to this step, advantageously, the spin rotor 140 with its rotor shaft 14 have already been removed from the bearing assembly 10. After the removal of the bearing assembly 10 and the removal of the clamp 18, the support disks 12 also are removed from the bearing block 11 for the sake of simplicity, so that further operational steps on the bearing block 11 can be carried out without difficulty.

The next work step in the rework program on the open-end spinning machine will be the necessary removal of the ball axial bearing 13 from the bearing block 11. This removal is accomplished by the literal cutting off of the ball axial bearing 13, for instance, by sawing. The cut is to be made along one of the separation lines marked, for example, as A to E, whereby the left and the right side of the bearing block 11 can possess the same, or different section lines (A, B, C, D, E). Because of the cutting off of the ball axial bearing 13, there arises along the cutoff lines (A to E) a separation surface to which connects the axial bearing carrier 4, which has an accommodating counter surface to accommodate a pneumatic axial bearing (See FIG. 2).

The bearing assembly 10 from FIG. 2 is a re-worked bearing assembly in accord with the invention. By the cutting off of the ball axial bearing (13) (see FIG. 1), the separation surface 25 is so free that an axial bearing carrier 4 of the bearing surface 41 for a pneumatic axial bearing 42 can be placed thereon in accord with the invention. The separation surface 25, as shown in FIG. 2, is remachined after the cutting off of the ball axial bearing 13, so that the cut separation surface 25 has a smooth flat surface onto which the axial bearing carrier 4 with its matching surface 45 can make a seamless joining. The machining of the separation surface 25 is carried out in the embodiment of FIG. 2 by means of machine cutting, that is, by milling. By the machining, the separation surface receives the requirement for the bearings of the support disks 12 and subsequent to this the rotor shaft 14 which is carried on the support disks 12. The separation surface then serves as a detent surface matching the complementary surface 45 of the axial bearing carrier 4.

The separation surface 25, which, in FIG. 2 is formed from two partial surfaces located respectively right and left of the V-notch of the bearing block 11, possesses two means of fastening 440, which are indicated in FIG. 2 by means of a dotted line. The fastening means comprises, respectively, a boring through which a threaded bolt can be run until it extends into the axial bearing carrier 4. The axial bearing carrier 4 lies with its matching surface 45 on the separating surface 25 of the bearing block 11. Separation surface 25 and matching surface 45 have been shaped to be complementary to one another. On this account, the bearing surface 41 of the pneumatic axial bearing 42 falls into its correct position following the assembly of the axial bearing carrier 4 in relation to the rest of the bearing components, and especially in relation to the free end of the rotor shaft 14.

In the assembly of the axial bearing carrier 4, and in the recess formed by a clamping element 46 for the pneumatic axial bearing 42, an assembly opening has been introduced that shows the position in which the matching surface 45 and the separation surface 25 must be affixed together by the fastening means 440. For the axial adjustment of the pneumatic axial bearing 42 in relation to the end of the rotor shaft, the clamping element 46 is in the shape of a clenched fist, so that the pneumatic axial bearing 42 can be fastened in the correct axial position with the clamp screw 47 on the axial bearing carrier 4. The axial bearing carrier 4 possesses respectively two fastening means 440. However, it is quite possible to also install these in a bearing block that has fastening means formed in a different manner.

FIG. 3 shows the ball axial bearing of FIG. 1 in a cross-sectional view. The rotor shaft 14 lies, when in operation, against the ball 5. For this purpose, the rotor shaft 14 has a recessed, cup-like detent which bears against the ball 5. The ball 5 for its part abuts the adjustment screw 22. The adjustment screw 22 is locked by means of the nut 220, and thus is non-rotatable. For the lubrication of the ball 5, a container for holding lubricant 31 is located below the ball. The lubricant is oil, which, is brought into contact with the surface of the ball 5 by means of a wick 32. A chamber 19 of the ball axial bearing 13, which is located above the oil container, is closed from above by the cover 20. The rotor shaft 14 extends into this chamber 19 through a penetrative opening, whereby it is encompassed by a surrounding shell 33 which aids in preventing the leakage of oil to the surroundings.

Alternative to the methods and ways depicted in FIGS. 1 and 2 for the separation of the ball axial bearing 13, it is entirely possible, that first the ball is removed from the ball axial bearing 13, and subsequently, in the interior of chamber 19, an axial bearing carrier is placed with a receiving module for the pneumatic axial bearing. For this purpose, the shell 33 as well as the ball retainer 51 must be removed. Ball retainer 51 limits the mobility of the ball 5 in the ball axial bearing. Then, on the cut surface of the shell 33, which now becomes a separation surface 300, there would be a matching complementary surface 45 of a correspondingly finished axial bearing carrier 4 (not shown).

In an additional embodiment for the removal of the ball axial bearing 13, the interior of the chamber 19 is machine finished to cylindrical form and on the now ring shaped separation surface 300, for instance, an annular axial bearing carrier 4 (not shown) is installed that takes up the bearing surface of a pneumatic axial bearing. The separation surfaces of the various embodiments of separation of the ball axial bearing are to fulfill their function, however, in the same manner as shown in FIGS. 1 and 2.

Figure 4:
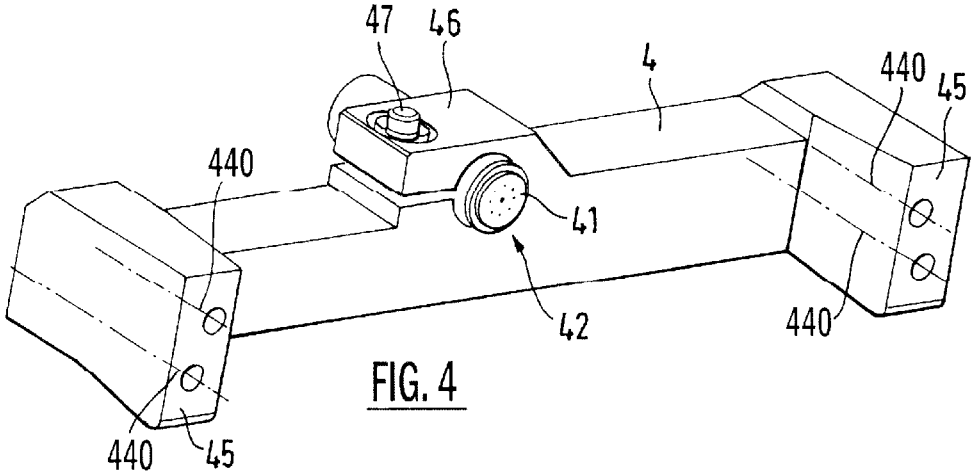
FIG. 4 shows the axial bearing carrier of FIG. 2 in a perspective presentation.

FIG. 4 shows the axial bearing carrier in accord with the invention and as it is installed in FIG. 2. The axial bearing carrier possesses, respectfully, right and left from the pneumatic axial bearing 42, a matching surface 45, with which it is positioned on the separation surface of a reworked bearing system. In order that installation may be made with various bearing blocks, for example, or from different spinning machine models, the axial bearing carrier 4 of FIG. 4 exhibits respectively two fastening means 440. Respectively, the upper means is a blind boring which is provided with an internal thread. Again respectively, the lower means is shown as a through boring through which a fastening device, such as a bolt, of the proper size can be screwed for fastening into the matching reworked bearing block. Besides the use of the boring as a fastening means, it can also serve for the exact positioning of the axial bearing carrier. To this purpose, for instance, other fastening devices, such as a drift pin or positioning pin, can be employed in the boring, which works together with a corresponding working separation surface of a reworked bearing block.

For the affixing of the pneumatic axial bearing 42 on the axial bearing carrier 4, the axial bearing carrier 4 possesses a clamp 46 designed in the form of a clenched fist. By means of bolt 47, the sheath-like designed pneumatic axial bearing 42 with its bearing plate 41 is fastened upon the axial bearing carrier. By means of the advantageous formation of axial carrier 4 and the clamp 46, the bearing plate can be located simply in its axial direction, axial being in reference to the axis of the rotor shaft. In operation, the axial bearing is provided with compressed air through a (not shown) air-feed line on the side of the bearing plate opposite to the bearing surface 41. Besides the described embodiments for separation and changes in the bearing arrangements, other embodiments are also possible. These other embodiments need only to refer to the above-described features to be able to make use of the pneumatic axial bearing and to position it correctly.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for reworking an open-end rotor spinning apparatus, said process comprising of the steps;

dismounting a bearing block from the open-end spinning apparatus, the bearing block maintaining support disks that form a V-notch in which a rotor shaft of a spin rotor resides and possessing a ball axial bearing abutting an end of the rotor shaft distal to the rotor;

separating the ball axial bearing from the bearing block forming a separating surface on the bearing block where separation occurs;

matching a complementary surface on an axial bearing carrier for a pneumatic axial bearing to the separating surface of the bearing block;

aligning the axial bearing carrier with the bearing block to insure proper placement of the axial bearing carrier relative to the rotor shaft of the spin rotor;

fastening the axial bearing carrier to the bearing block in a manner that maintains alignment of the axial bearing carrier relative to the rotor shaft of the spin rotor, adjusting the alignment as need; and reinstalling the bearing block back into the open-end spinning apparatus.

2. A process as in claim 1, wherein the separating of the ball axial bearing from the bearing block is performed in essentially one plane parallel to a plane formed by the support disks.

3. A process as in claim 2, wherein the separating of the ball axial bearing from the bearing block is performed in essentially one plane between two planes which are formed by two pairs of support disks supporting the spin rotor shaft.

4. A process as in claim 2, wherein the separating of the ball axial bearing from the bearing block is performed at least perpendicular to the plane formed by the support disks.

5. A process as in claim 1, wherein the separating of the ball axial bearing from the bearing block is performed at least partially by boring or milling the bearing block in at least directions perpendicular or parallel to the planes of thy support disks.

6. A process as in claim 1, wherein the separating of the ball axial bearing from the bearing block is performed by machine cutting methods.

7. A process as in claim 1, wherein the separating of the ball axial bearing from the bearing block is performed by non-machine cutting methods.

8. A process as in claim 1, wherein the separating surface on the bearing block is machined.

9. A process as in claim 1, wherein the separating surface possesses a fastening means to affix the axial bearing carrier.

10. A process as in claim 1, wherein the separating surface defines a boring through which a fastening device may-enter.

11. A process as in claim 10, wherein the separating surface defines a thread in the boring.

12. A process as in claim 1, wherein the fastening of the axial bearing carrier is performed in a manner that it is a force fit.

13. A process as in claim 1, further comprising inserting a pneumatic axial bearing into the axial bearing carrier.

14. A process as in claim 1, wherein the axial bearing carrier is aligned with the bearing block to insure proper placement of the pneumatic axial bearing relative to the rotor shaft of the spin rotor.

15. A bearing apparatus formed by reworking an open-end rotor spinning apparatus, said apparatus comprising:

a pneumatic axial bearing for a rotor shaft of a spin rotor, said pneumatic axial bearing absorbing the axial force generated by said spin rotor during normal operations of said open-end spinning apparatus;

a bearing surface operably disposed to an end of said pneumatic axial bearing proximal to said rotor shaft of said spin rotor;

a bearing block which maintains support disks that form a V-notch in which a rotor shaft of a spin rotor resides, said bearing block having had a ball axial bearing separated from it forming a separating surface on said bearing block at a position where such separation occurred;

an axial bearing carrier having a complementary surface that matches said separating surface such that said axial bearing carrier is aligned and fastened to said bearing block;

a clamp operably disposed to said axial bearing carrier, said clamp holding said pneumatic axial bearing in place so that said bearing surface is properly positioned relative to an end of said rotor shaft distal to a rotor end of said spin rotor.

16. A bearing apparatus as in claim 15, wherein said separating surface is machined.

17. A bearing apparatus as in claim 15, wherein at least said separating surface of said bearing block or said complementary surface of said axial bearing carrier is provided with a fastening means that allows said bearing carrier to be affixed to said bearing block.

18. A bearing apparatus as in claim 15, wherein at least said separating surface of said bearing block or said complementary surface of said axial bearing carrier defines a boring through which positioning pins are slidably disposable.

19. A bearing apparatus as in claim 18, wherein at least said separating surface of said bearing block or said complementary surface of said axial bearing carrier defines a thread in said boring into which bolts are screwable.

20. A bearing apparatus as in claim 15, wherein said separating surface of said bearing block provides a centering surface to align said axial bearing carrier on the bearing block.

* * * * *